US005219407A

United States Patent [19]

Herring Lloyd W.

[11] Patent Number: 5,219,407

[45] Date of Patent: Jun. 15, 1993

[54] CURTAINS FOR IRREGULAR SHAPED WINDOWS

[76] Inventor: Herring Lloyd W., 5727 Etiwanda Ave., Ste. 7, Tarzana, Calif. 91356

[21] Appl. No.: 801,521

[22] Filed: Dec. 2, 1991

[51] Int. Cl.[5] ..... A47H 1/00

[52] U.S. Cl. ..... 160/330; 160/84.1

[58] Field of Search ..... 160/330, 134, 38, 349.1, 160/348, 371, 377, 19; 428/4

[56] References Cited

U.S. PATENT DOCUMENTS

| | | | |
|---|---|---|---|
| 2,532,837 | 12/1950 | De Puy | 160/377 |
| 3,115,181 | 12/1963 | Snyder | 160/330 X |
| 4,825,611 | 5/1989 | Bassett | 160/372 X |
| 5,044,418 | 9/1991 | Donahue | 160/134 X |
| 5,063,985 | 11/1991 | Bozzo | 160/134 X |

*Primary Examiner*—Blair M. Johnson

*Attorney, Agent, or Firm*—Blakely, Sokoloff, Taylor & Zafman

[57] ABSTRACT

A window covering typically used for irregular shaped windows. The cover includes a frame having two ends that can be connected together, such that the frame encloses and defines a curtain area that generally approximates the shape of the window. The frame is typically constructed from a metal tube bent into the desired shape. The window cover also includes a curtain that has a pocket along one edge. The pocket is adapted to be pulled over the tubing to attach the curtain to frame. To assemble the cover, the ends of the frame are disconnected and one end is inserted into the pocket of the curtain. The curtain is pulled over the tubing until the pocket extends around the entire length of the frame. The curtain is typically constructed to cover the curtain area within the frame. The ends of the tube are then connected together and the cover assembly is mounted onto a wall next to the window.

22 Claims, 7 Drawing Sheets

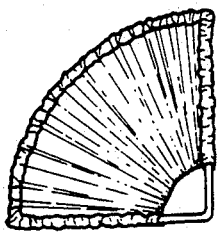
FIG. 3a
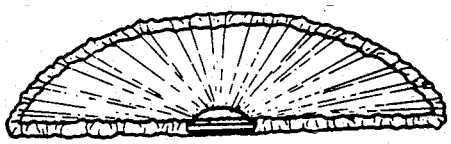
FIG. 3b
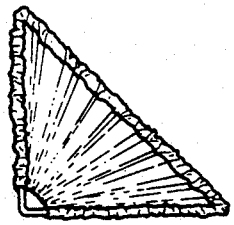
FIG. 3c
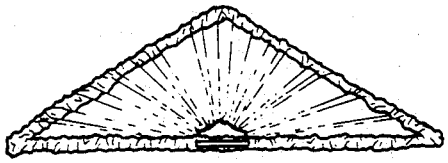
FIG. 3d
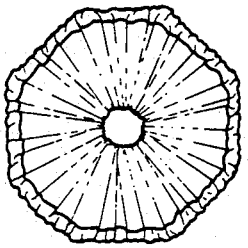
FIG. 3e
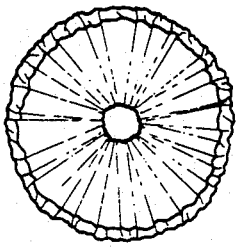
FIG. 3f
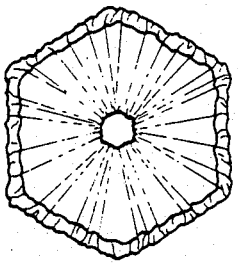
FIG. 3g
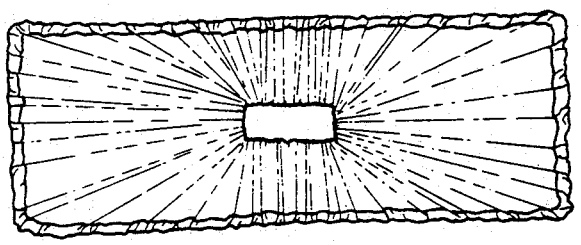
FIG. 3h
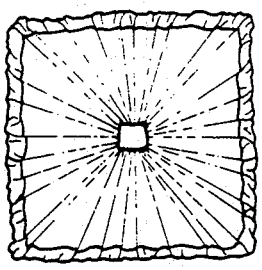
FIG. 3i
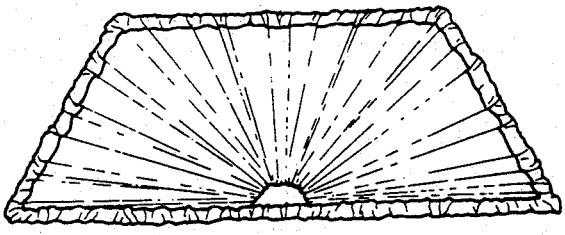
FIG. 3j
FIG. 3k
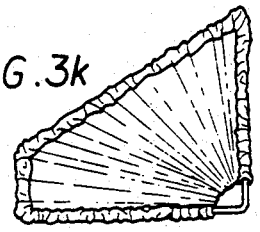
FIG. 3L
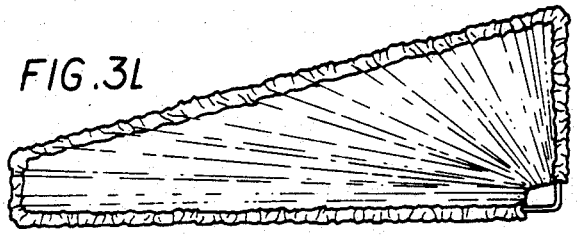

CURTAINS FOR IRREGULAR SHAPED WINDOWS

BACKGROUND OF THE INVENTION

1. Field of the Invention

The present invention is a window cover that relates generally to the art of curtains, drapes and shades.

2. Description of Related Art

The windows of residential homes (and some commercial buildings) typically have some type of curtain or shade to provide the occupant with a certain amount of privacy. Curtains are usually hung from curtain rods that are fastened to the wall above the window. Some windows are circular in shape or have a radial arch. A home owner who wants to cover an irregular shaped window, typically must hire a specialist who custom builds the curtain or shade.

One type of irregular shaped curtain includes a wooden frame that is cut, typically from a single sheet of plywood, into a shape that corresponds to the profile of the window. In the smaller sizes, the form consists of a base section and an integral arc member, but in the larger sizes, an integral vertical center spoke is included to resist warpage and distortion of the frame. The wood frame is covered with a white drapery lining to conceal the raw wood frame. The fabric is stapled into pleats around the radius of the frame, wherein the pleats are stapled to the bottom center of the frame to create a sunburst effect. A shirred fabric trim or valance is then applied around the edge of the frame to conceal the staples. A fabric ornament is sewn or otherwise attached over the gathered fabric on the bottom center of the frame.

The resulting window covering is then attached to the wall adjacent to the window, most commonly by a drapery installer with specialized hardware and tools. Such a method of construction is both time consuming and costly. Additionally, when the curtain becomes damaged by sun rot, or worn through time, the fabric and sometimes even the frame must be replaced. Therefore it would be desirable to have a commercially available window cover for irregular shaped windows, that is easy to assemble and allows the curtain to be removed for cleaning, replacement or repair.

SUMMARY OF THE INVENTION

The present invention is a window covering typically used for irregular shaped windows. The cover includes a frame having two ends that can be connected together, such that the frame encloses and defines a curtain area that generally approximates the shape of the window. The frame is typically constructed from a metal tube bent or cut and welded into the desired shape. The window cover also includes a curtain that has a pocket along one edge. The pocket is adapted to be pulled over the tubing to attach the curtain to frame.

To assemble the cover, the ends of the frame are disconnected and one end is inserted into the pocket of the curtain. The curtain is pulled over the tubing until the pocket extends around the length of the frame. The curtain is typically constructed to cover the entire curtain area within the frame. The ends of the tube are then connected together and the cover assembly is mounted onto a wall next to the window. The curtain can be removed by dismounting the cover assembly from the wall, disconnecting the ends of the tubes and pulling the curtain off of the frame.

Therefore it is an object of this invention to provide a window covering for irregular shaped windows.

It is also an object of this invention to provide a window covering, that allows the curtain to be easily removed from the frame, so that the curtain can be replaced, cleaned or repaired by the end user.

It is also an object of this invention to provide a window covering that is easy to assemble by the end user.

It is also an object of this invention to provide a commercially available window cover for irregular shaped windows, that can be easily purchased and installed by the end user.

BRIEF DESCRIPTION OF THE DRAWINGS

The objects and advantages of the present invention will become more readily apparent to those skilled in the art after reviewing the following detailed description and accompanying drawings, wherein:

FIG. 15*d* is a perspective view showing the single rosette of FIG. 15*c* attached to a board;

DETAILED DESCRIPTION OF THE INVENTION

Figure 1:
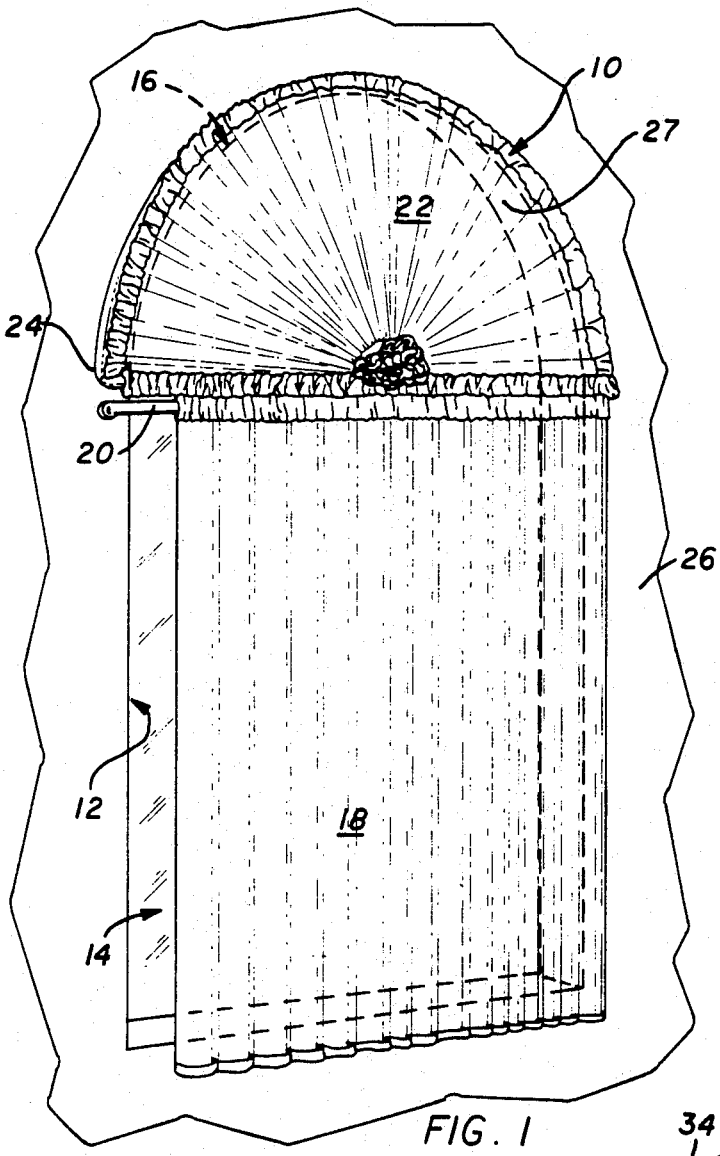
FIG. 1 is a perspective view of a window cover of the present invention mounted onto a window.

Referring to the drawings more particularly by reference numbers, FIG. 1 shows a window cover 10 of the present invention mounted to a window 12. The window 12 may have a rectangular section 14 and a radial section 16. The rectangular section 14 may be covered by a drape 18 that hangs from a linear curtain rod 20, as is typically found in the art. The window cover 10 covers the radial section 16 of the window 12. The cover 10 has a first curtain 22 attached to a frame 24, that is mounted to the wall 26. The window 12 is typically inset within the wall 26, such that there is an archway 27 formed above the window 12. Although a rectangular window section 14 is shown and described, it is to be understood that the present invention may be used for irregular shaped windows that do not have an adjoining rectangular window section 14.

Figure 2A:
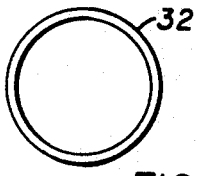
FIG. 2*a* is a cross-sectional view showing the tube with a circular cross-section.
Figure 2B:
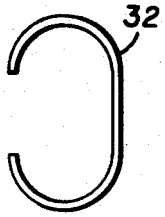
FIG. 2*b* is a cross-sectional view showing a tube with a "C" shaped cross-section.
Figure 2C:
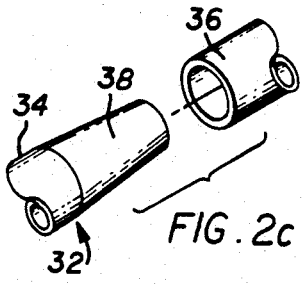
FIG. 2*c* is a perspective view of the ends of the frame.
Figure 2D:
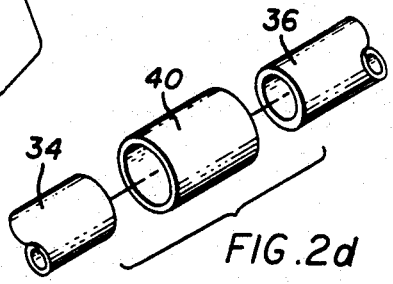
FIG. 2*d* is a perspective view of an alternate a "C" shaped cross-section.
Figure 2:
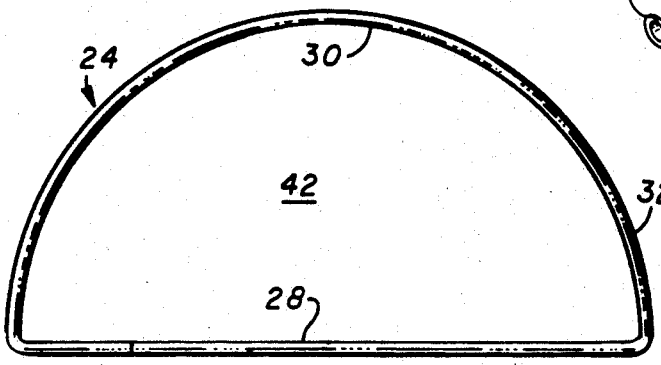
FIG. 2 is a top view of a frame of the window cover of FIG. 1.

FIG. 2 shows the frame 24 without the curtain 22. The frame 24 has a semi-circular shape and is typically larger than the archway 27, so that the frame 24 can be mounted to the wall 26. It being understood that the frame 24 can be equal to or less than the archway 27, wherein the window cover 10 is attached to the inside surface of the archway 27. The frame 24 has a base portion 28 and a radial portion 30, that are preferably constructed from a single metal tube 32.

In the preferred embodiment, the tube is constructed from 0.5 inch aluminum. The tube 32 may have a continuous cross-section as shown in FIG. 2*a*, or have a "C" section as in FIG. 2*b*. The C-Section tube can be constructed from a single sheet of metal bent into the desired cross-section. The tube 32 is bent into the desired form with techniques known in the art. The tube 32 has a first end 34 and a second end 36 that can be joined together. FIG. 2*c* shows a preferred embodiment of the tube 32, wherein the first end 34 has a taper 38 that can be inserted into the second end 36. FIG. 2*d* shows an alternate embodiment of the frame, that includes a connecting tube 40 with an outer diameter smaller than the inner diameter of the tube 32, so that the connecting tube 40 can be inserted into the ends 34 and 36, to attach the frame 24 together. The ends 34 and 36 are typically formed in the base portion 28, but may be located in the radial portion 30 of the frame 24. Once the ends are connected, the frame 24 encloses and defines a curtain area 42 that generally approximates the shape of the window. Although a semi-circular frame is shown, it is to be understood that the frame may be formed into other shapes, shown with attached curtains in FIGS. 3*a*–3*r*.

Figure 4:
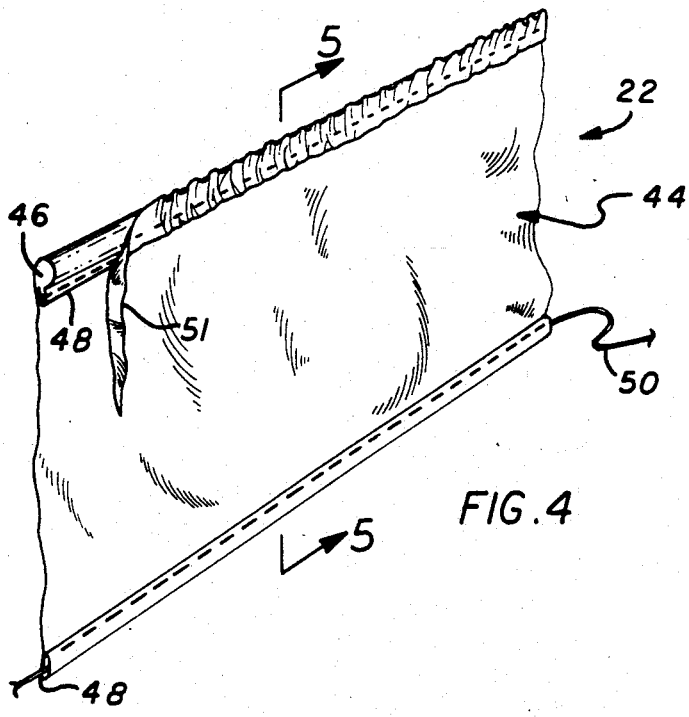
FIG. 4 is a perspective view of a curtain of the window cover of FIG. 1.
Figure 5:
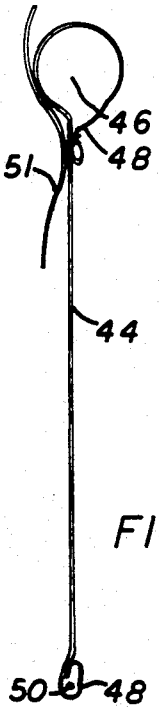
FIG. 5 is a cross-sectional view of the curtain of FIG. 4 taken at line 4—4, showing a pocket of the curtain.

FIG. 4 shows a preferred embodiment of a first curtain 44 that can be attached to the frame 24. The curtain 44 is typically constructed from a cloth material, cut and sown into the desired shape and size. As shown in FIG. 5, the curtain 44 has a first pocket 46 that is formed by folding and sewing one edge 48 of the cloth. The pocket 46 is slightly larger than the outer diameter of the tube 32, so that the pocket 46 can be pulled over the frame 24. For example, if the tube 32 has a 0.5 inch diameter, the pocket can be 0.875 inches wide. The curtain 44 may also have a second pocket 48 formed on the other end of the cloth, which may be for example 0.5 inches wide. The second pocket 48 has an opening that allows a first draw string 50 to be inserted therethrough. The draw string 50 is preferably a nylon cord. A valance 51 may be sewn to the first pocket 46 to fully cover the frame 24, when the curtain 22 is attached.

Figure 6:
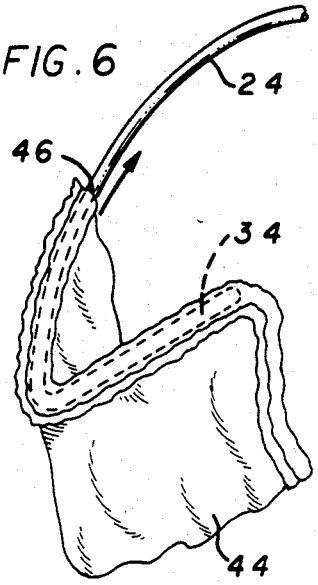
FIG. 6 is a perspective view showing the curtain of FIG. 4 being pulled onto the frame of FIG. 2.
Figure 7:
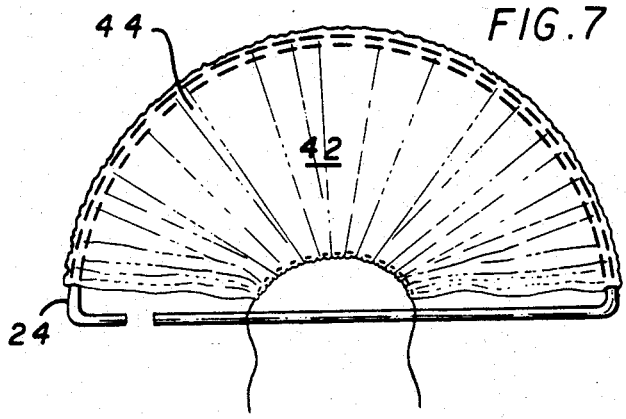
FIG. 7 is a top view showing the curtain completely pulled around the frame.
Figure 8:
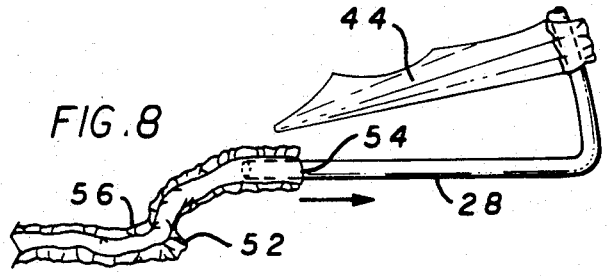
FIG. 8 is a top view showing a strip being pulled onto the base portion of the frame.

FIGS. 6–8 show a method of attaching the curtain 44 to the frame 24. One of the ends 34 or 36, of the frame 24 is inserted into the first pocket 46. The curtain 44 is then pulled over the tube 32, until the pocket 46 extends around the circumference of the radial portion. As shown in FIG. 7, the curtain 44 covers a substantial portion of the curtain area 42 defined by the frame 24. The curtain 44 is preferably longer than the length of the radial portion 30, so that the attached curtain has a folded fringe. In the preferred embodiment the curtain 44 is 2.25 times longer than the radial portion of the tube 32.

As shown in FIG. 8, a cloth strip 52 having a strip pocket 54 may be pulled over the base portion 28 of the frame. The strip 52 may also be longer than the base portion 28, so that the attached material is folded along the length of the strip. The strip 52 may be constructed from other non-cloth material and may have a valance 56 sewn thereto. The strip 52 is used primarily to cover the base portion 28 of the frame. It being understood that instead of a separate strip, the curtain 44 may extend completely around the frame 24. By way of example, the frames shown in FIGS. 3*e*, 3*f*, 3*g*, 3*h*, 3*i* and 3*o* are covered by a single curtain 44 that extends around the entire circumference of the assembly, though it should be understood that such a configuration may be used with any other shape as desired.

Figure 9:
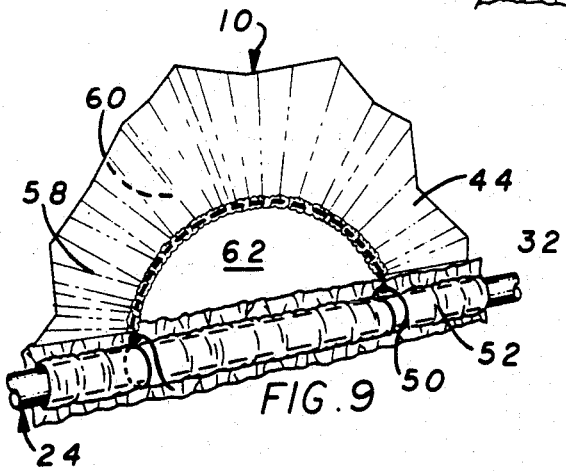
FIG. 9 is a perspective view showing the curtain tied to the base portion of the frame.

As shown in FIG. 9, the first draw string 50 is drawn tight and tied around the strip 52 and tube 32, to secure the edge of the curtain 44 to the frame 24. The draw string 50 is preferably secured to the frame by wrapping the string around the tube, beginning with the first side (back) 58 of the curtain 10, and then tying a knot, again at the first side (back) 58 of the curtain 10. Such a method causes the curtain 44 to protrude towards the second side (front) 60 of the cover, thereby improving the overall appearance of the finished product. The fastened curtain 44 creates an opening 62 typically having a shape similar to the frame 24.

Figure 10:
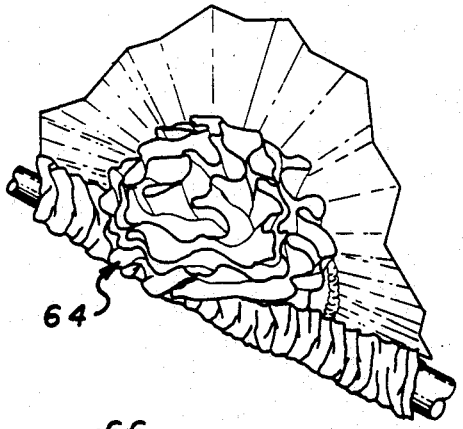
FIG. 10 is a perspective view of a window cover that has an ornament member inserted into an opening formed in the curtain.
Figure 11:
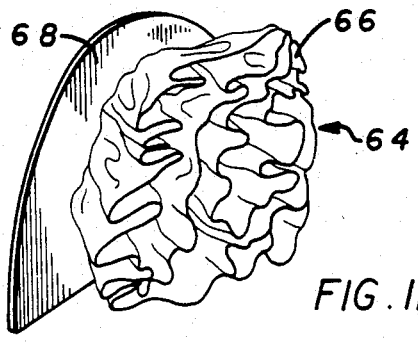
FIG. 11 is a perspective view showing a strip used to create the ornament member of FIG. 11.
Figure 12C:
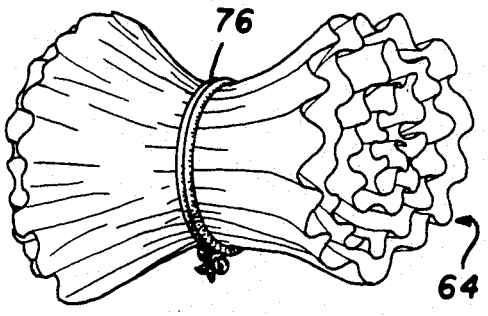
FIG. 12*c* is a perspective view showing the strip of FIG. 12*b* rolled and tied into a double rosette.
Figure 13:
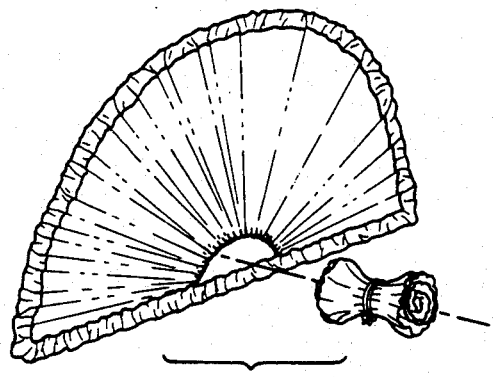
FIG. 13 is an exploded perspective view showing the double rosette of FIG. 12*c* and the curtain of FIG. 7.
Figure 14:
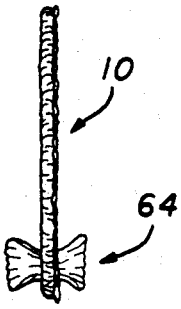
FIG. 14 is a side view of a double rosette inserted into a curtain.
Figure 12:
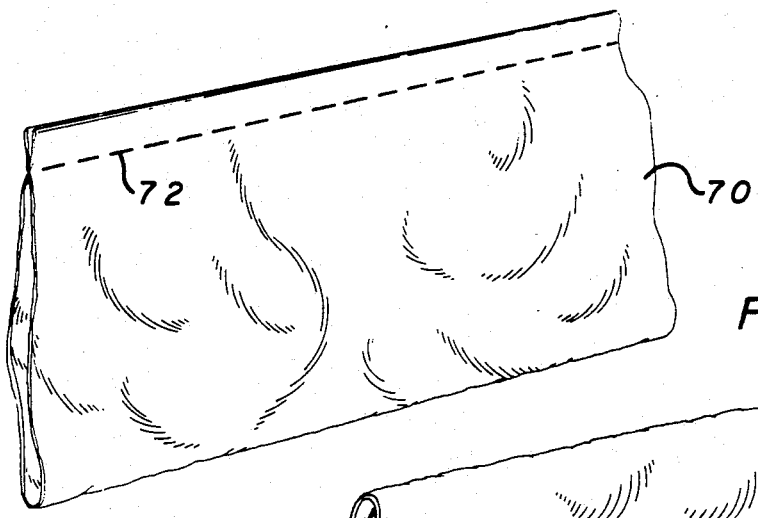
FIG. 12*a* is a perspective view showing the strip of FIG. 11 with a center pocket.
FIG. 12*b* is a perspective view showing the strip of FIG. 12*a* compressed by a draw string.
Figure 12A:
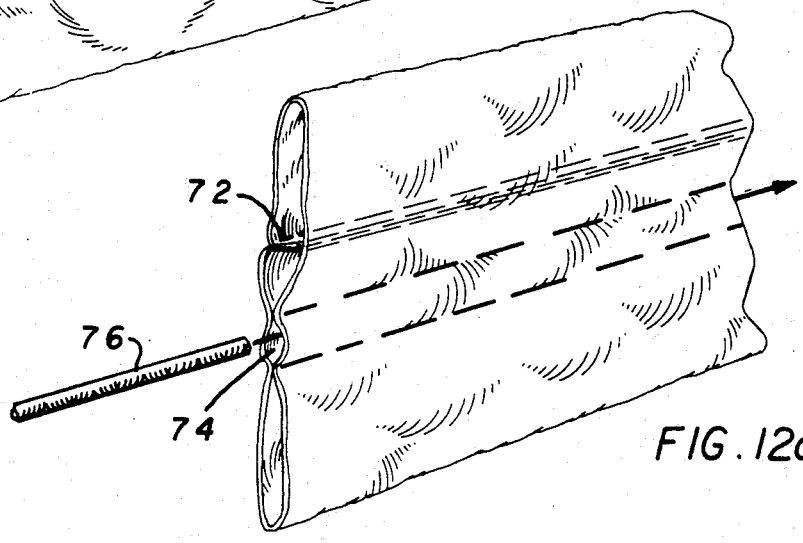
Figure 12B:
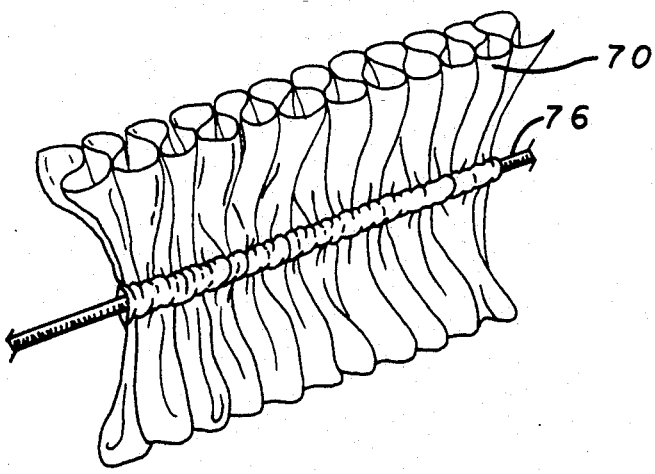
Figure 15C:
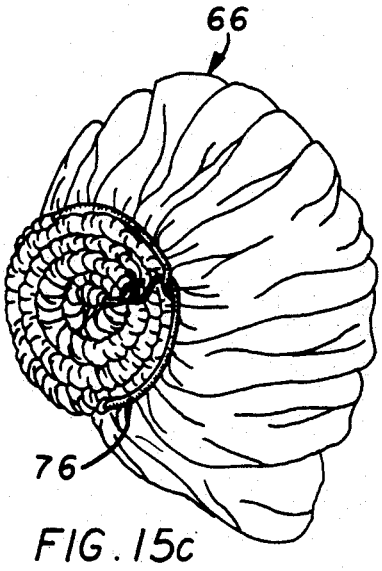
FIG. 15*c* is a perspective view showing the strip of FIG. 15*b* rolled and, tied into a single rosette.

As shown in FIG. 10, an ornament member 64 can be inserted into the opening to change the appearance of the cover 10. The ornament 64 is typically constructed from a cloth material similar to the curtain 44. FIGS. 12–14 show a preferred method of constructing the ornament 66. A strip 70 of cloth is folded and sewn as shown in FIG. 11. The sewn strip 70 is then turned inside out so that the stitch 72 is facing inward. As shown in FIG. 12*a*, an ornament pocket 74 is then sewn into the strip. In the preferred embodiment, the ornament pocket 74 is in the center of the strip and the stitch is off-center, 2 inches from one end and 2.5 inches from the other end of the strip. A second draw string 76 is inserted through the ornament pocket 74 and drawn to compress the strip 70 as shown in FIG. 12*b*. The strip 70 is then rolled and tied at the base to create the ornament as shown in FIG. 12*c*. The above method creates an ornament 64 with two rosettes. As shown in FIGS. 13 and 14, the ornament 64 is inserted into the opening of the curtain, such that a rosette extends from each side of the curtain.

Figure 3M:
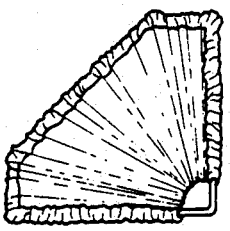
FIG. 3*a*–3*r* are top views of alternate shapes of the window cover.
Figure 3N:
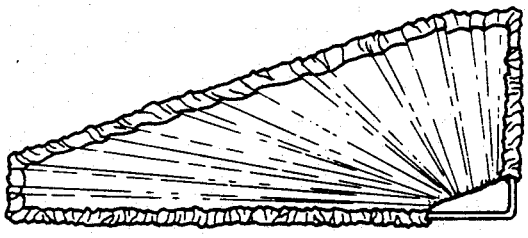
Figure 3O:
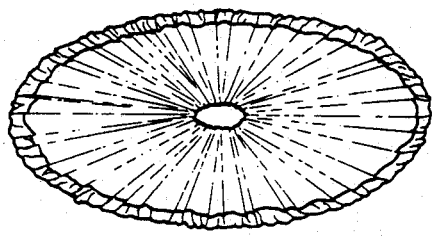
Figure 3P:
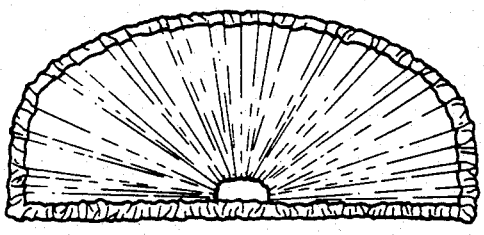
Figure 3Q:
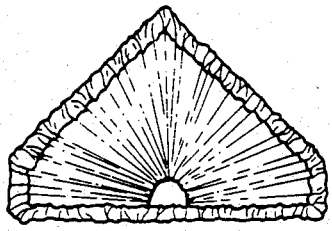
Figure 3R:
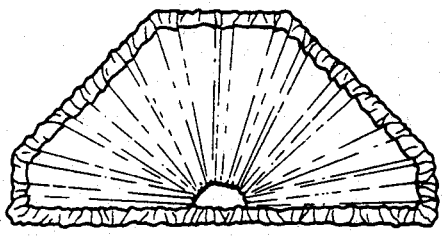
Figure 15A:
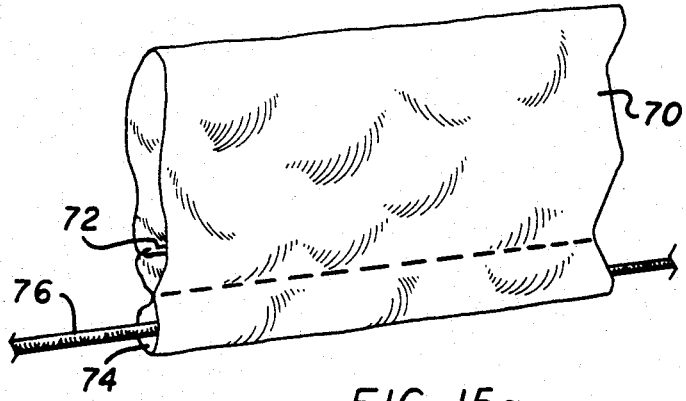
FIG. 15*a* is a perspective view showing the strip of FIG. 11 with an end pocket.
Figure 15B:
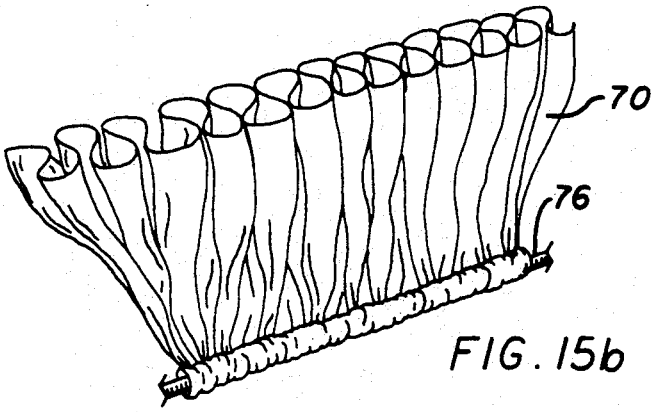
FIG. 15*b* is a perspective view showing the strip of FIG. 15*a* compressed by a draw string.
Figure 16:
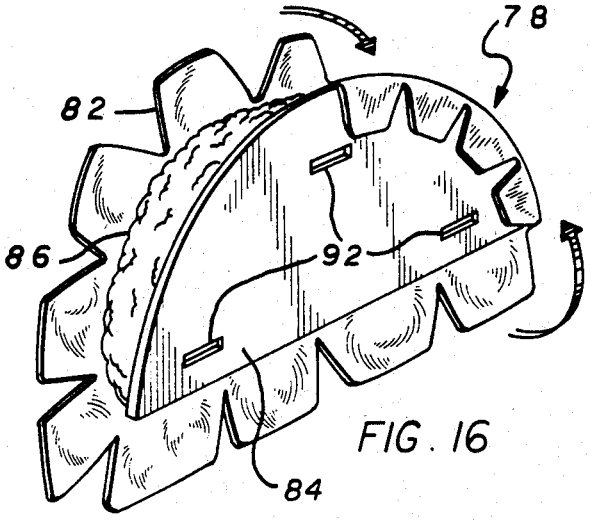
FIG. 16 is a perspective view of a padded ornament.
Figure 17:
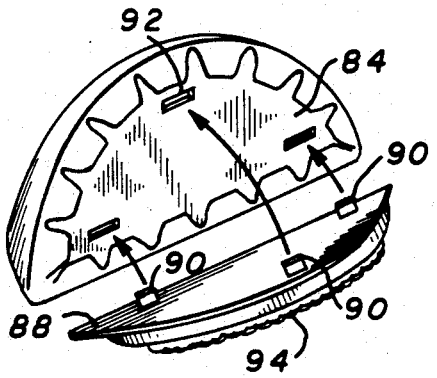
FIG. 17 is a perspective view showing a board attached to the padded ornament of FIG. 16.
Figure 18:
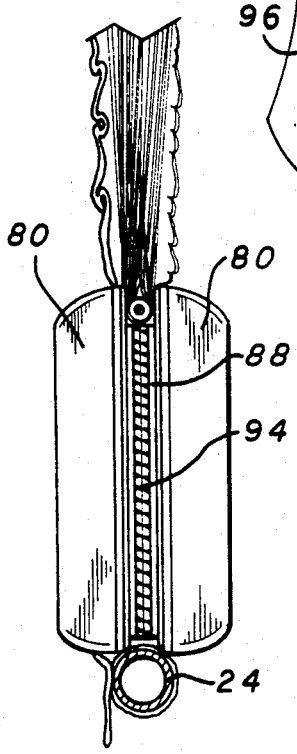
FIG. 18 is a side view showing two padded ornament members connected together through an opening of a curtain.

FIGS. 15*a*–15*d* show another embodiment of an ornament member 64' that has a single rosette 66 attached to a board 68. The rosette 66 is constructed from a sewn cloth 70 that has a pocket 74' at one end, as shown in FIG. 15*a*. The cloth is drawn and rolled to the single rosette configuration shown in FIG. 15*c*. The single rosette 66 is then attached to the board 68. The ornament 66 can be attached to the board 68 by any means including glue, or hook and loop material commonly sold under the trademark VELCRO. The ornament member 64' is attached to the curtain by inserting the ornament through the opening 62, so that the ornament 66 is extending from the second side (front) of the curtain 44, and the board 68 is adjacent to the first side (back) of the curtain 44. FIGS. 16–18 show the construction of another ornament member 78 that includes a pair of padded ornaments 80. As shown in FIG. 16, the padded ornament 80 is assembled by folding a cut piece of fabric 82 over a backplate 84. Padding 86 can be placed between the fabric 82 and backplate 84. As shown in FIG. 17, a hardboard 88 is attached to the backplate 84, preferably with a plurality of tabs 90 that "snap" into slots 92 formed into the backplate 84. The hardboard 88 has fastening means 94 such as VELCRO that allow two ornament members 78 to be connected through the opening of the curtain 44, as shown in FIG. 18. The hardboards 88 are typically smaller than the opening 62 and the backplates 84, so that only the boards 88 extend through the curtain 44. The easy engagement and detachment of the padded ornament 80 from the hardboard 88, allows the padded member 80 to be replaced by ornaments of different shapes or colors. Although semi-circular ornament members 64 and 78 have been shown, it is to be understood that other shapes may be constructed to fit the contours of the openings as shown in FIGS. 3*a*–3*r*.

Figure 19:
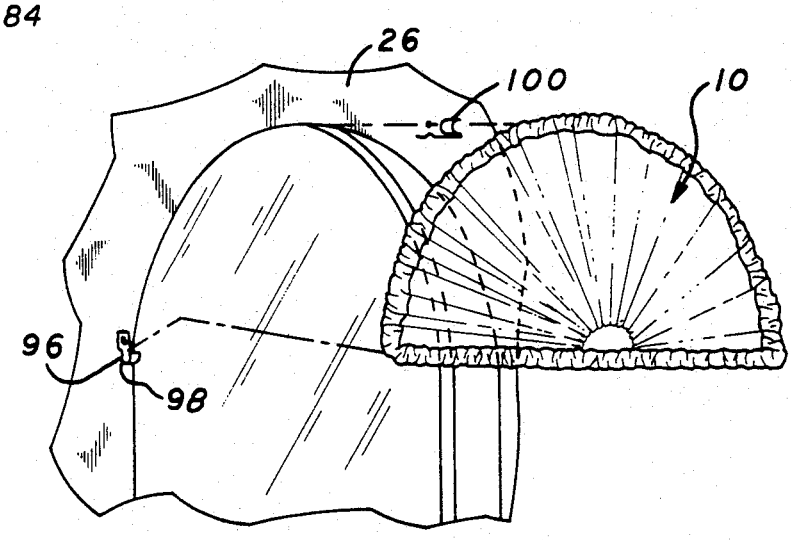
FIG. 19 is an exploded view showing the attachment of the window cover to a wall adjacent to a window.
Figure 20:
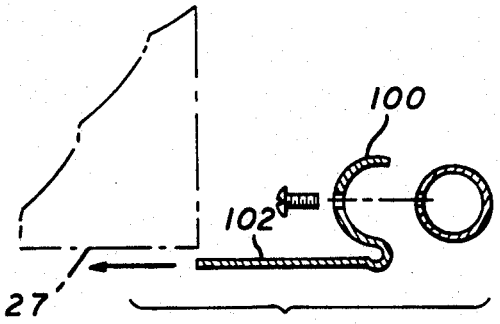
FIG. 20 is an exploded view of the top portion of the window cover attached to the archway by a spring.

FIG. 19 shows a method of mounting the cover 10 to the wall 26. A pair of U shaped brackets 96 can be screwed into the wall 26, such that the frame 24 can be supported by the U shaped cups 98 of the brackets 96. A second bracket 100 can be screwed into the top of the frame 24. As shown in FIG. 20, the second bracket 100 has a spring 102 that engages the archway 27 to prevent the top of the frame 24 from rotating downward. The cover 10 is preferably installed by placing the spring 102 under the archway 27 and pushing the bottom of the frame into the brackets 96.

The present invention thus provides a window cover 10 that can be used for irregular shaped windows. The window cover 10 also provides the added advantage of being repairable. If the curtain 44 becomes damaged or dirty, or if the frame 24 breaks or becomes distorted, the curtain 44 can be removed from frame 24 and a new member can be incorporated. For instance, to clean the curtain 44, the user merely dismounts the cover 10, disconnects the frame 24 and pulls the curtain 44 off of the tube 32.

While certain exemplary embodiments have been described in detail and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A window covering for covering at least a portion of a window, the window portion having a predefined shape, comprising:

a rod having a pair of ends adapted to be connected together such that said rod encloses and defines a curtain area that approximates the predefined shape of the window, said frame having a radial portion and a base portion;

a curtain having a pocket constructed to slide over said radial portion of said rod and attach said curtain to said rod such that said curtain covers at least a portion of said curtain area; and, a curtain strip, separate from said curtain, that has a second pocket adapted to be pulled over said base portion of said rod.

2. The window covering as recited in claim 1, wherein said rod is constructed from a metal tube.

3. The window covering as recited in claim 1, wherein said curtain covers at least a substantial portion of said curtain area, said curtain having a first side and a second side, and being constructed to define an opening.

4. The window covering as recited in claim 3, further comprising an ornament member located within said opening.

5. A window covering for covering at least a portion of a window, the window portion having a predefined shape, comprising:

a rod having a pair of ends adapted to be connected together such that said rod encloses and defines a curtain area that approximates the predefined shape of the window; and, a curtain having a pocket constructed to slide over said rod and attach said curtain to said rod such that said curtain covers at least a portion of said curtain area, said curtain having a first side, a second side and is constructed to define an opening; and, an ornament attached to a board, said ornament extending from said first side of said curtain and said board extending from said second side of said curtain.

6. The window covering as recited in claim 5, wherein said ornament has a rosette constructed from a rolled strip of cloth that has a draw string that extends through a pocket sewn into said strip.

7. The window covering as recited in claim 5, wherein said ornament member includes an ornament attached to a board, said ornament extending from said first side of said curtain and said board extending from said second side of said curtain.

8. The window covering as recited in claim 7, wherein said ornament is a rosette constructed from a rolled strip of cloth that has a draw string that extends through a pocket sewn into said strip.

9. The window covering as recited in claim 5, wherein said ornament has a pair of rosettes constructed from a rolled strip of cloth that has a draw string that extends through a pocket sewn into said strip.

10. The window covering as recited in claim 5, wherein said ornament includes a pair of padded ornament members attached together through said opening such that a padded ornament extends from each side of said curtain.

11. The window covering as recited in claim 5, wherein said curtain has a second pocket along a second edge of said curtain, said second pocket containing a draw string that attaches said second edge to said base portion of said frame, said second pocket and said base portion defining an opening that approximates a segment of a circle.

12. The window covering as recited in claim 11, further comprising an ornament ember located within said opening.

13. The window covering as recited in claim 12, wherein said ornament member includes an ornament attached to a board, said ornament extending from said first side of said curtain and said board extending from said second side of said curtain.

14. The window covering as recited in claim 13, wherein said ornament is a rosette constructed from a strip of cloth that has a draw string that extends through a pocket sewn into said strip.

15. The window covering as recited in claim 12, wherein said ornament has a pair of rosettes constructed from a strip of cloth that has a draw string that extends through a pocket sewn into said strip.

16. The window covering as recited in claim 12, further comprising a pair of padded ornament members attached together through said opening such that a padded ornament extends from each side of said curtain.

17. The window covering as recited in claim 16, wherein said padded ornaments are detachably connected to hardboards that can be fastened together through said opening.

18. A window covering for covering at least a portion of a window, the window portion having a predefined shape, comprising:

a rod having a pair of ends adapted to be connected together such that said rod encloses and defines a curtain area that approximates the predefined shape of the window; and, a curtain having a pocket constructed to slide over said rod and attach said curtain to said rod such that said curtain covers at least a portion of said curtain area, said curtain having a first side, a second side and is constructed to define an opening; and, a pair of rosettes that extend from said curtain constructed from a rolled strip of cloth that has a draw string that extends through a pocket sewn into said strip.

19. A window covering for covering at least a portion of a window, the window portion having a predefined shape, comprising:

a rod having a pair of ends adapted to be connected together such that said rod encloses and defines a curtain area that approximates the predefined shape of the window; and, a curtain having a pocket constructed to slide over said rod and attach said curtain to said rod such that said curtain covers at least a portion of said curtain area, said curtain having a first side, a second side and is constructed to define an opening; and, a pair of padded ornament members attached together through said opening such that a padded ornament extends from each side of said curtain.

20. The window covering as recited in claim 19, wherein said padded ornaments are detachably connected to hardboards that can be fastened together through said opening.

21. The window covering as recited in claim 1, wherein said rod is shaped as a segment of a circle having a base portion and a radial portion.

22. A window covering for covering at least a portion of a window, the window portion having a window casement and a predefined shape, comprising:

a window casement;

at least one rod having a pair of ends adapted to be connected together such that said rod encloses and defines a curtain area that approximates the predefined shape of the window;

a curtain having a pocket constructed t slide over said rod and attach said curtain to said rod such that said curtain covers at least a portion of said curtain area; and, at least one clip having a radial portion attached to said rod and a spring portion which frictionally engages said window casement thereby attaching said rod and curtain to said window casement.

* * * * *